US006722254B1

(12) United States Patent
Davies

(10) Patent No.: US 6,722,254 B1
(45) Date of Patent: Apr. 20, 2004

(54) MUZZLE BRAKE

(76) Inventor: Robert B. Davies, 433 E. McKinley St., Tempe, AZ (US) 85281-1026

( * ) Notice: Subject to any disclaimer, the term of this patent is extended or adjusted under 35 U.S.C. 154(b) by 0 days.

(21) Appl. No.: 10/002,378

(22) Filed: Nov. 14, 2001

(51) Int. Cl.[7] ..... F41A 21/00
(52) U.S. Cl. ..... 89/14.3; 42/1.06
(58) Field of Search ..... 89/14.3; 42/1.06

(56) References Cited

U.S. PATENT DOCUMENTS

| | | | | | |
|---|---|---|---|---|---|
| 3,707,899 | A | * | 1/1973 | Perrine | 89/14.3 |
| 3,769,731 | A | * | 11/1973 | Pachmayr et al. | 42/79 |
| 4,459,895 | A | * | 7/1984 | Mazzanti | 89/14.3 |
| 4,545,285 | A | * | 10/1985 | McLain | 89/14.3 |
| 4,562,767 | A | * | 1/1986 | Janssen et al. | 89/14.3 |
| 4,570,529 | A | * | 2/1986 | A'Costa | 42/78 |
| 5,005,463 | A | * | 4/1991 | A'Costa | 89/14.2 |
| 5,136,923 | A | * | 8/1992 | Walsh, Jr. | 89/14.2 |
| 5,596,161 | A | | 1/1997 | Sommers | |
| 6,308,609 | B1 | | 10/2001 | Davies | |
| 6,425,310 | B1 | * | 7/2002 | Champion | 89/14.3 |
| 6,450,079 | B1 | * | 9/2002 | Bourdin et al. | 89/14.3 |

* cited by examiner

*Primary Examiner*—Michael J. Carone
*Assistant Examiner*—M. Thomson
(74) *Attorney, Agent, or Firm*—Parsons & Goltry; Robert A. Parsons; Michael W. Goltry

(57) ABSTRACT

A muzzle brake for use with a gun includes a cylindrically shaped hollow body having internal threads adjacent the rear end for threadedly attaching the body to the muzzle of the gun adjacent the bore coaxially along a longitudinal axis of the barrel. The body defines an axially extending internal chamber with a flat transverse wall adjacent the forward end. Longitudinally extending, helically shaped slots are formed through the body and in communication with the internal chamber. The slots are equally distributed about the body, and each of the slots has a forward end that is angled generally toward the rear end from an inner periphery of the body to an outer periphery of the body. Each of the slots is further defined by parallel sidewalls defining an opening with an axis offset (non-intersecting) from the longitudinal axis of the barrel. The internal threads and the offset of the slots are oriented so that propellant gases escaping through the slots strike one of the sidewalls and tend to thread the muzzle brake tighter onto the barrel of the gun.

21 Claims, 3 Drawing Sheets

FIG. 8
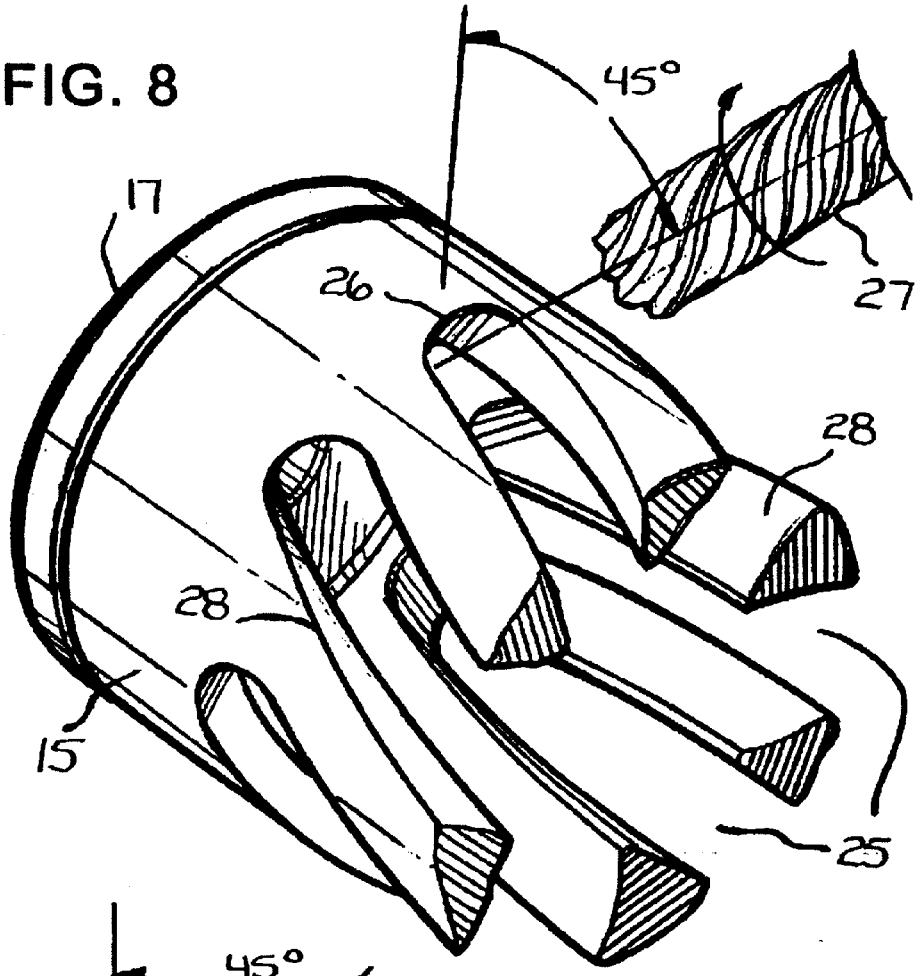
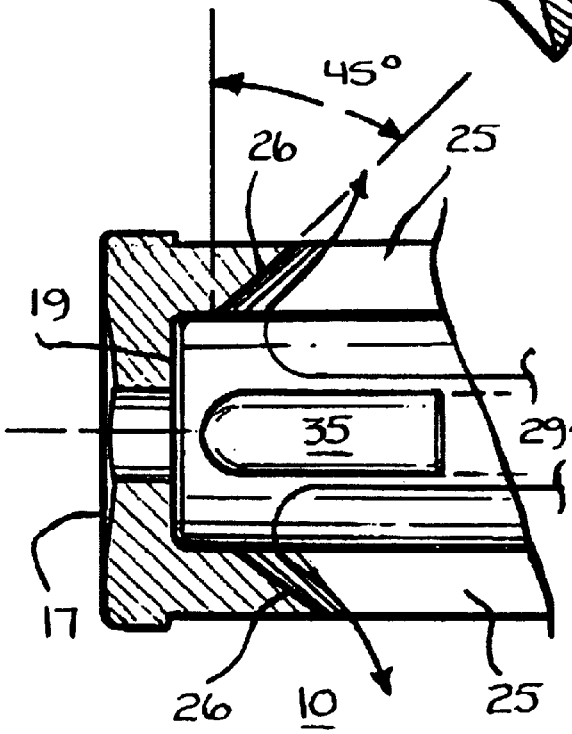
FIG. 9
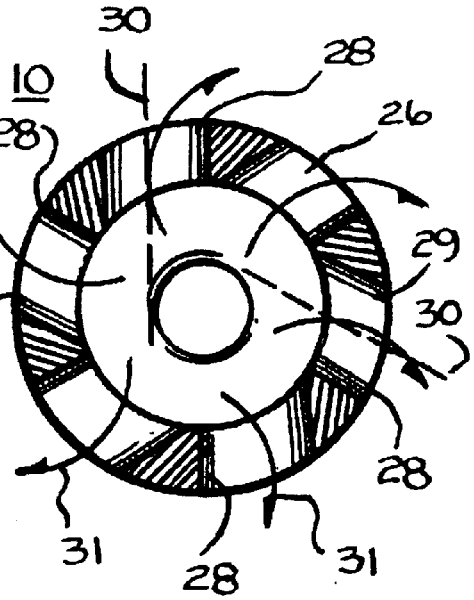
FIG. 10

MUZZLE BRAKE

FIELD OF THE INVENTION

This invention relates to projectile weapons.

More particularly, the present invention relates to muzzle brakes for use in reducing recoil on projectile weapons.

BACKGROUND OF THE INVENTION

Muzzle brakes have been used in the past to reduce the recoil action of a gun when it is fired. Muzzle brakes employ the forward momentum of a pressure wave produced by expanding exhaust gas upon detonation of a cartridge. By deflecting some of such exhaust gas in a suitable manner, a forward impulse is generated on the brake and hence the barrel of the gun. This forward impulse balances, to some degree, the recoil impulse on the barrel of the gun.

A muzzle brake usually incorporates at least two transverse vanes for deflecting the exhaust gases. The inside of the brake communicates with the two vanes to receive the gases, such vanes being integral with the outside of the brake. When a projectile is fired, the propellant gases are guided by vents towards the vanes on which they exert a thrust thereby offsetting the gun barrel recoil.

Many and diverse muzzle brakes have been developed over the years. Many brakes attempt to compensate for the movement of a gun muzzle by providing an opposing force. Typically, gun barrels rise when fired due to the disposition of the center of mass relative the axis of the bore. To compensate, many muzzle brakes deflect more of the gas upward. While somewhat effective in reduce muzzle rise, gases are unevenly stripped from behind the projectile often resulting in uneven force exerted on the projectile. The uneven forces can result in inaccuracies through projectile yaw.

Additionally, removal of large amounts of material from a cylinder to form vents greatly weakens the structure of the brake. Often, the brake is weakened enough that a blow to the brake will result in a deformation. This is unacceptable as a deformed muzzle brake can present a significant chance of injury to the operator, as well as rendering the gun unusable.

It would be highly advantageous, therefore, to remedy the foregoing and other deficiencies inherent in the prior art.

Accordingly, it is an object of the present invention to provide a new and improved muzzle brake for projectile type weapons.

Another object of the invention is to provide a muzzle brake designed to improve the accuracy of the projectile type weapon.

And another object of the invention is to provide a muzzle brake which is safe and easy to use and which reduces the amount of firing noise.

Still another object of the present invention is to provide a muzzle brake that uniformly disperses the propellant gases.

Yet another object of the invention is to provide a self-tightening muzzle brake that is rugged and can be used with other accessories, such as sound suppressors, flash suppressors, etc.

SUMMARY OF THE INVENTION

Briefly, to achieve the desired objects of the instant invention in accordance with an embodiment thereof, provided is a muzzle brake for use with a gun having a barrel muzzle and a bore. The muzzle brake includes a cylindrically shaped hollow body having a rear end attachable to the barrel at the muzzle coaxially along the axis of the bore and a forward end. A plurality of longitudinally extending, helically shaped slots are formed through the body, the slots being substantially equally distributed about the body. Each of the slots ends in an angularly disposed end wall adjacent the forward end of the body and the end wall in each of the slots is angled generally toward the rear end from an inner periphery of the body to an outer periphery of the body.

To further achieve the desired objects of the instant invention, a preferred embodiment of a muzzle brake for use with a gun, having a barrel muzzle and a bore, includes a cylindrically shaped hollow body having a rear end and a forward end. The body has attachment apparatus adjacent the rear end for attaching the body to the barrel adjacent the muzzle coaxially along a longitudinal axis of the bore of the barrel. The cylindrically shaped hollow body defines an axially extending internal chamber with an inlet end and an outlet end and a transverse wall adjacent the forward end of the cylindrically shaped hollow body. A plurality of longitudinally extending, helically shaped slots are provided through the body in communication with the internal chamber. The slots are substantially equally distributed about the body and each of the slots ends in an angularly disposed end wall adjacent the forward end of the body, the end wall in each of the slots being angled generally toward the rear end from an inner periphery of the body to an outer periphery of the body.

In this preferred embodiment, the plurality of helically shaped slots each include first and second substantially parallel sidewalls defining an opening through the body with an axis offset from the axis of the bore. The offset and the helical formation of the slots causes propellant gases to uniformly swirl about the body and to produce a substantially rotary force on the body. The attachment apparatus and the rotary force are oriented so that propellant gases escaping through the helical slots tend to tighten the muzzle brake onto the barrel of the gun. The propellant gases also strike the transverse wall adjacent the forward end of the cylindrically shaped hollow body and the angularly disposed end walls of the slots to provide some relief of the normal firing recoil.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 8 is an enlarged perspective view of a muzzle brake, portions thereof removed and shown in section, illustrating tooling for fabrication in accordance with the present invention;

FIG. 9 is an enlarged sectional view of the portion of the muzzle brake illustrated in FIG. 8;

FIG. 10 is an end view of the portion of the muzzle brake illustrated in FIG. 8.

DETAILED DESCRIPTION OF THE PREFERRED EMBODIMENTS

Figure 1:
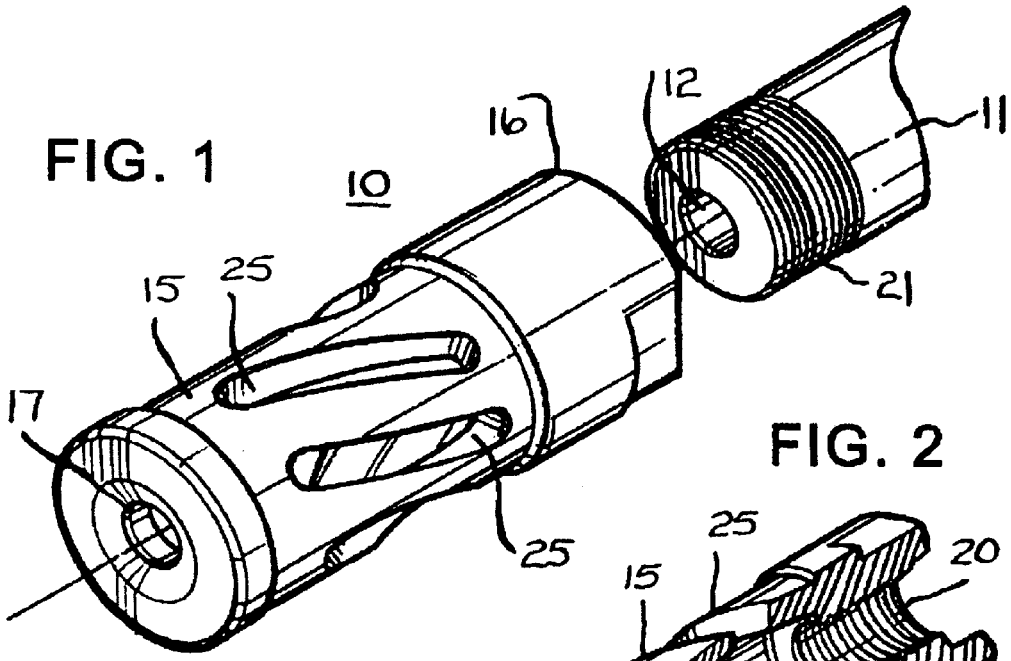
FIG. 1 is a perspective view illustrating a muzzle brake according to the present invention.
Figure 2:
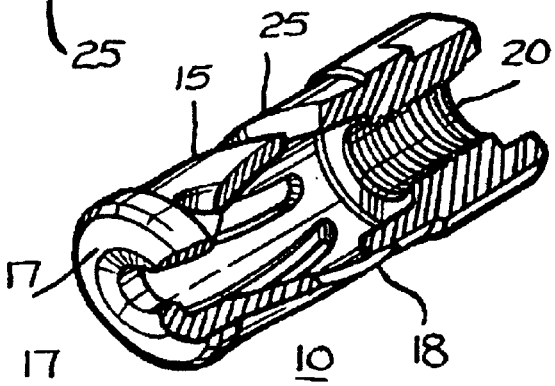
FIG. 2 is a perspective view of the muzzle brake of FIG. 1, portions thereof removed and shown in section.
Figure 5:
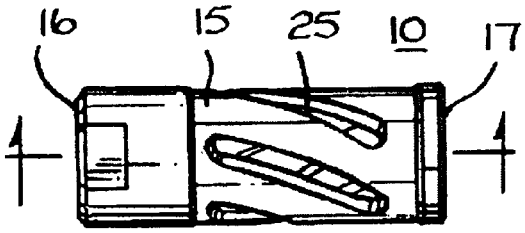
FIGS. 5 and 6 are side and top plan views, respectively, of the muzzle brake of FIG. 1.
Figure 6:
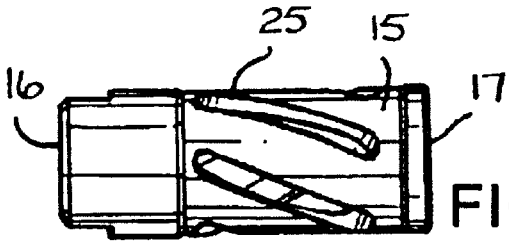
Figure 3:
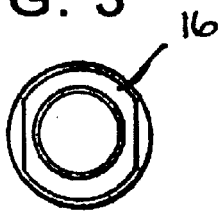
FIGS. 3 and 4 are opposite end views of the muzzle brake of FIG. 1.
Figure 4:
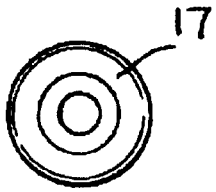
Figure 7:
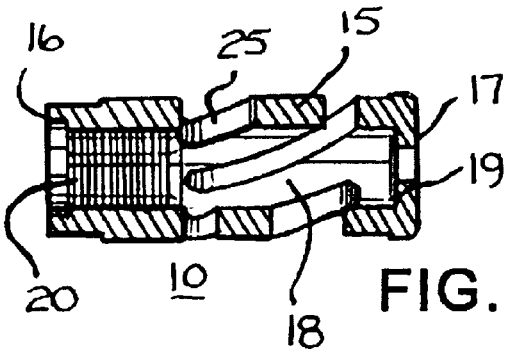
FIG. 7 is a sectional view as seen from the line 7—7 of FIG. 5.
Figure 11:
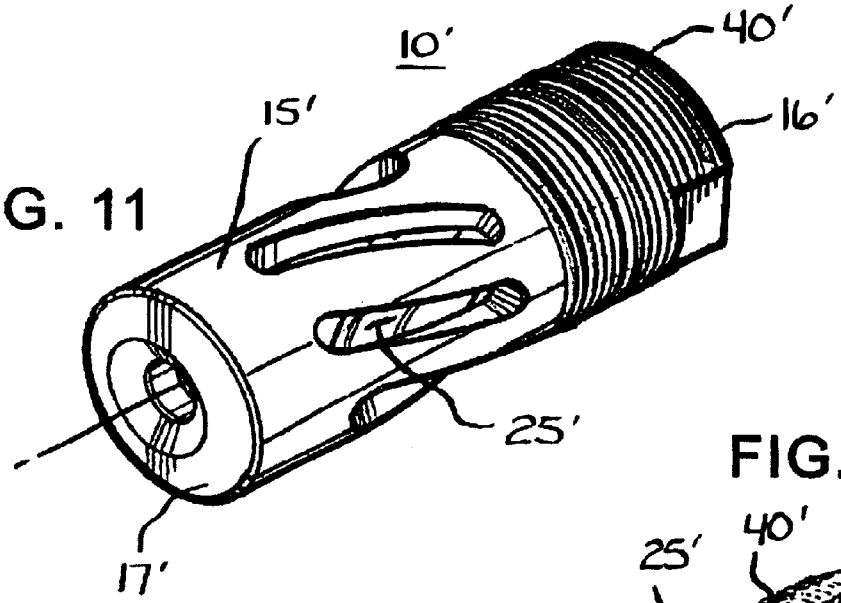
FIGS. 11 through 17 are views similar to FIGS. 1 through 7 of a different embodiment of a muzzle brake, in accordance with the present invention.
Figure 12:
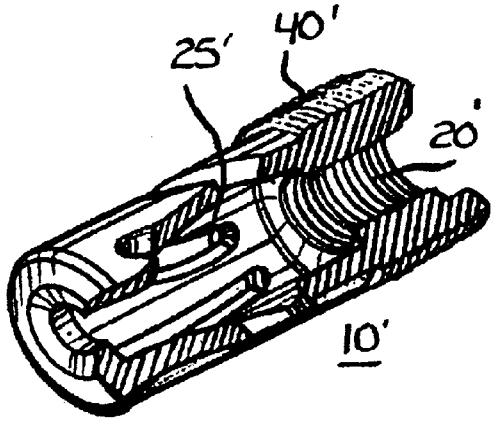
Figure 15:
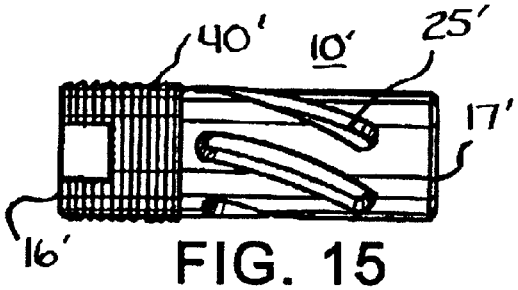
Figure 16:
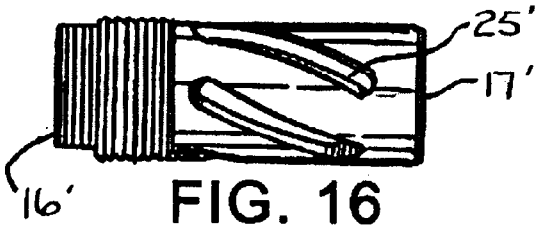
Figure 13:
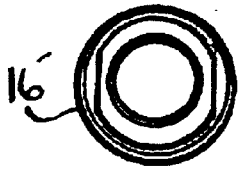
Figure 17:
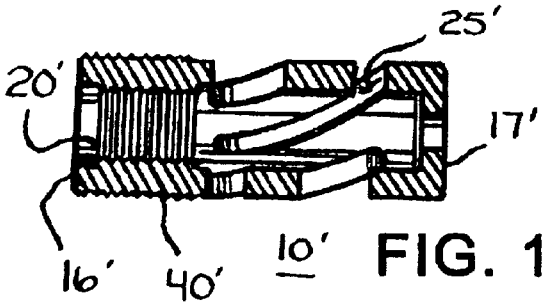
Figure 14:
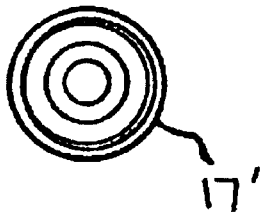

Turning now to the drawings in which like reference characters indicate corresponding elements throughout the several views, attention is first directed to FIG. 1, which illustrates a muzzle brake 10 for use with a gun having a barrel muzzle 11 and a bore 12. Muzzle brake 10 includes a cylindrically shaped hollow body 15 having a rear end 16, attachable to barrel muzzle 11 adjacent bore 12 coaxially along the axis of bore 12, and a forward end 17. Muzzle brake 10 is attachable to barrel muzzle 11 by any convenient attachment apparatus, such as well known "snap-on" structures or the like, and in this preferred embodiment the attachment apparatus includes internal threads 20 adjacent rear end 16 and matching external threads 21 on barrel muzzle 11 adjacent bore 12. For additional reference, a partially broken away view is illustrated in FIG. 2 to provide a view of the internal structure of brake 10, a rear end view and a forward end view are provided in FIGS. 3 and 4, and top plan, side elevation and sectional views are provided in FIGS. 5, 6, and 7, respectively.

Cylindrically shaped hollow body 15 defines an internal chamber 18 with an inlet opening (see FIG. 3) in rear end 16 of body 15 having an inner diameter approximately equal to an outer diameter of barrel muzzle 11 and an outlet opening (see FIG. 4) in forward end 17 of body 15 approximately equal to, but greater than, the diameter of bore 12. Internal chamber 18 has a substantially flat transverse wall 19 (see FIGS. 7 and 9) adjacent forward end 17 of cylindrically shaped hollow body 15. While wall 19 is illustrated as substantially flat in this embodiment, it should be understood that other configurations (e.g., angled from the transverse, roughened, etc.) could be incorporated. In this preferred embodiment, transverse wall 19 extends from the outlet opening in forward end 17 of body 15 transversely outwardly a distance slightly greater than the diameter of the inlet opening in rear end 16 of body 15. It will of course be understood that the shape of internal chamber 18 may vary substantially in different applications from the preferred shape illustrated.

A plurality of longitudinally extending, helically shaped slots 25 are provided through body 15. Slots 25 are substantially equally distributed about body 15. In the example illustrated in FIGS. 1 through 7, six slots are provided which are evenly spaced approximately 60° apart. It will be understood that two slots will be placed approximately 180° apart, four slots will be placed approximately 90°, five slots will be placed approximately 72° apart, eight slots will be placed approximately 45° apart, etc. Also, because slots 25 a re parallel and extend helically around body 15 as they progress longitudinally along body 15, in this specific embodiment the front end of one slot is approximately in an axially extending line with the rear end of the next adjacent slot.

Each slot 25 ends in an angularly disposed end wall 26 adjacent forward end 17 of body 15, as best seen in FIGS. 8 and 9, end wall 26 in each slot 25 being angled generally toward rear end 16 from an inner periphery of body 15 to an outer periphery of body 15. End wall 26 in each slot 25 is formed to define an angle with a transverse axis or radius of body 15 (see FIG. 9) in a range of approximately 20° to approximately 60°, and in this preferred embodiment is illustrated as being 45°. The angle of end walls 26 can be easily formed through the use of an e nd mill, drill, or the like, designated 27 in FIG. 8.

As can best be seen in FIG. 10, each helically shaped slot 25 include s first and second substantially parallel sidewalls 28 and 29 defining an opening through body 15 with an axis 30 (at any specific point along the helix) offset (non-intersecting) from the axis of bore 12. In the specific six slot embodiment illustrated, each slot 2S is formed with sidewalls 28 and 29 oriented generally parallel with a radius of cylindrically shaped body 15 and each slot 25 is positioned so that sidewall 28 lies substantially parallel a radius and opposed sidewall 29 is offset to the radius of cylindrically shaped body 1S. It will be understood that both of the first and second sidewalls 28 and 29 could be oriented at an angle to a radius and positioned so that they are both offset from a radius. This particular configuration results in each of the slots being offset from bore 12 so that most of the propellant gases do not exit in a direct path radially outwardly from internal chamber 18, but swirl generally helically about body 15, as indicated by arrows 31. Thus, the combination of helical slots 25 and the offset of the slots operates as a force redirection system, redirecting the force of the propellant gases from the normal radially outward movement to an evenly distributed swirl or helical movement.

It will also be noted that the angle of each opposed sidewall 29 and internal threads 20 are oriented so that propellant gases escaping through helical slots 25 strike opposed sidewalls 29 and tend to thread muzzle brake 10 tighter onto barrel muzzle 11. For example, opposed sidewalls 29 of slots 25 are illustrated with a clockwise angle (best seen in FIG. 10). To match this angle, internal threads 20 and matching threads 21 are right-handed, i.e., muzzle brake 10 is turned clockwise in FIG. 1 to threadedly engage it onto barrel muzzle 11. Thus, each time the gun is fired, propellant gases escaping through slots 25 strike opposed sides 29 and tend to tighten muzzle brake 10 on barrel muzzle 11.

In operation, with muzzle brake 10 firmly attached to barrel muzzle 11, each time the gun is fired propellant gases escape through slots 25. Because slots 25 are equally distributed around body 15, the energy is equally distributed in a complete 360° about the axis of bore 12. Further, slots 25 are offset from a radius or transverse axis of bore 12 so that most of the propellant gases cannot escape in a direct radial path from internal chamber 18. Thus, the propellant gases escaping through slots 25 are evenly dispersed, along with sound produced by the propellant gases. Because of the equal dispersion, the directivity of the sound and other accompanying effects (e.g., flash) are greatly reduced.

As a projectile 35 (see FIG. 9) moves through internal chamber 18 of body 15, propellant gases disperse outwardly and exit through slots 25. Because the propellant gases are distributed equally or in a controlled pattern, uneven forces on projectile 35 and/or on barrel muzzle 11, are substantially eliminated so that accuracy of the gun is improved. That is, the propellant gases are striped evenly and in a controlled pattern from projectile 35 so that uneven pressure on projectile 35 is substantially eliminated. Thus, uneven pressures that can cause yaw or other inaccuracies of projectile 35 are eliminated.

Some of the propellant gases exiting through slots 25 strike angularly disposed end walls 26 of slots 25 and are deflected rearwardly. The energy dissipated by the reversal in direction of the propellant gases is opposite to and partially offsets the normal recoil of the gun. Some of the propellant gases travel the length of internal chamber 18 with projectile 35 and strike transverse wall 19. The energy of the propellant gases striking transverse wall 19 further reduces or offsets the normal recoil of the gun. Also, the propellant gases traveling the length of internal chamber 18 are redirected rearwardly by transverse wall 19 and continue to combust to provide a more complete combustion of the gases within internal chamber 18 so that the normal large blooming (flash) of propellant gases is evenly dispersed and, thus, greatly reduced. Further, propellant gases striking flat transverse wall 19 reflect an energy pulse that interferes with and substantially distributes the normal sound spike (energy profile) produced by the escaping propellant gases radially about the axis of bore 12.

In this preferred embodiment muzzle brake 10 is formed from one solid piece of metal or the like with all components thereof integrally connected. Because of the novel formation of muzzle brake 10, it is a very robust system that will not easily bend or become miss-aligned as, for example, when dropped or otherwise struck. Further, muzzle brake 10 can easily be finished to form a natural-looking portion of barrel muzzle 11.

Turning now to FIGS. 11 through 17, another embodiment of a novel muzzle brake 10' is illustrated. In this embodiment all components similar to components in FIGS. 1 through 7 are designated with similar numbers and a prime is added to all numbers to indicate the different embodiment. Also, components similar to components in FIGS. 1 through 7 will not be discussed in detail since they are similarly formed and provide a similar function.

Muzzle brake 10' includes a body 15' with a rear end 16' and a forward end 17'. External threads 40' are provided at rear end 16' for the mounting of extra accessories, such as "cans" (not shown) forming flash suppressors, sound suppressors, or combinations of the two. The cans include an opening at the rear end thereof with internal threads for the insertion of muzzle brake 10' and threaded engagement with external threads 40'. Generally, as is known in the art, the cans extend forwardly beyond forward end 17' of muzzle brake 10' to aid in suppressing propellant gases that exit forward end 17' of muzzle brake 10' with the projectile. External threads 40' are formed opposite to internal threads 20' (e.g., left-handed versus right-handed) so that any tendency of escaping propellant gases to tighten muzzle brake 10' on a gun barrel also tend to tighten any cans or other extra accessories on muzzle brake 10'. Here it should be noted that propellant gases escaping through slots 25' in muzzle brake 10' are redirected by the helical slots and the offset position of the slots, so that the swirling gases produce a force on a can threaded onto external threads 40' which is in a direction to tend to thread the can tighter onto threads 40'. This constitutes a force preservation system, wherein the force from the escaping gases is preserved and employed to tighten the accessories can on the muzzle brake.

Thus, a new and improved muzzle brake is disclosed that disperses propellant gases in a controlled or uniform pattern to substantially reduce recoil. Also, the propellant gases are stripped from the projectile evenly and uniformly so that no uneven pressures are produced on the projectile that can cause inaccuracies. The muzzle brake is also designed with a force redirection system so that propellant gases tend to tighten it on a barrel so that it never becomes loose and dangerous. The swirling gases escaping from the helical slots in the muzzle brake not only tighten the muzzle brake on the muzzle of a gun but they also continue outwardly and provide a force tending to tighten additional accessories, with opposite threads or attachment apparatus, onto the muzzle brake. Further, the escaping propellant gases are redirected so as to continue burning within the muzzle brake to substantially reduce blooming of the gases and to offset or interfere with the normal energy profile so as to equally distribute the noise. Because of the novel formation of the muzzle brake, it is a very robust system that will not easily bend or become miss-aligned as, for example, when dropped or otherwise struck.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A muzzle brake for use with a gun having barrel axis, a muzzle and a bore, the muzzle brake comprising:

a cylindrically shaped hollow body having a rear end, attachable to the muzzle adjacent the bore coaxially along the barrel axis, and a forward end; and a plurality of longitudinally extending, helically shaped slots through the body, the slots being substantially equally distributed about the body, and each of the slots ending in an angularly disposed end wall adjacent the forward end of the body, the end wall in each of the slots being angled generally toward the rear end from an inner periphery of the body to an outer periphery of the body.

2. A muzzle brake as claimed in claim 1 wherein the angularly disposed end wall of each of the plurality of helically shaped slots is angled generally toward the rear end of the body at an angle in a range of approximately 20 degrees to 60 degrees.

3. A muzzle brake as claimed in claim 1 wherein each of the plurality of helically shaped slots includes first and second sidewalls defining an opening with an axis offset or non-intersecting with the barrel axis.

4. A muzzle brake as claimed in claim 3 wherein the plurality of helically shaped slots are evenly distributed to form pairs of opposed slots with the first sidewall of each slot in a pair of opposed slots lying approximately parallel to a common diameter of the cylindrically shaped body.

5. A muzzle brake as claimed in claim 4 wherein the cylindrically shaped body includes internal threads adjacent the rear end of the body adapted to threadedly engage the barrel of the gun at the muzzle.

6. A muzzle brake as claimed in claim 5 wherein the internal threads and the offset of each opposed sidewall are oriented so that propellant gases escaping through the helical slots strike one of the sidewalls and thread the muzzle brake tighter onto the barrel of the gun.

7. A muzzle brake as claimed in claim 1 wherein the cylindrically shaped hollow body defines an internal chamber with an inlet end having an inner diameter at least as large as an outer diameter of the muzzle and an outlet end at least as large as the diameter of the bore of the barrel.

8. A muzzle brake as claimed in claim 7 wherein the internal chamber defined by the cylindrically shaped hollow body has a transverse wall adjacent the forward end of the cylindrically shaped hollow body.

9. A muzzle brake as claimed in claim 8 wherein the transverse wall of the internal chamber is substantially flat.

10. A muzzle brake as claimed in claim 1 further including threads in the outer periphery of the cylindrically shaped hollow body for attaching additional accessories.

11. A muzzle brake as claimed in claim 1 wherein the cylindrically shaped hollow body is fabricated as an integral structure.

12. A muzzle brake as claimed in claim 1 wherein the plurality of longitudinally extending, helically shaped slots are disposed to redirect escaping gases in a helical pattern about the body.

13. A muzzle brake for use with a gun having a barrel axis, a muzzle and a bore, the muzzle brake comprising:

a cylindrically shaped hollow body having a rear end and a forward end, the body having attachment apparatus adjacent the rear end for attaching the body to the barrel adjacent the muzzle coaxially along a longitudinal axis of the barrel;

the cylindrically shaped hollow body defining an axially extending internal chamber with an inlet end and an outlet end, the internal chamber defined by the cylindrically shaped hollow body having a transverse wall adjacent the forward end of the cylindrically shaped hollow body;

a plurality of longitudinally extending, helically shaped slots through the body in communication with the internal chamber, the slots being substantially equally distributed about the body, and each of the slots ending in an angularly disposed end wall adjacent the forward end of the body, the end wall in each of the slots being angled generally toward the rear end from an inner periphery of the body to an outer periphery of the body; and the plurality of helically shaped slots including first and second sidewalls defining an opening with an axis offset or non-intersecting with the barrel axis, the attachment apparatus and the offset of each slot being oriented so that propellant gases escaping through the helical slots strike one of the sidewalls and tend to tighten the muzzle brake onto the barrel of the gun.

14. A muzzle brake as claimed in claim 13 wherein the angularly disposed end wall of each of the plurality of helically shaped slots is angled generally toward the rear end of the body at an angle in a range of approximately 20 degrees to 60 degrees.

15. A muzzle brake as claimed in claim 13 wherein the attachment apparatus includes internal threads in the cylindrically shaped body adjacent the rear end of the body adapted to threadedly engage the muzzle of the gun adjacent the bore.

16. A muzzle brake as claimed in claim 15 further including threads in the outer periphery of the cylindrically shaped hollow body for attaching additional accessories, the threads in the outer periphery of the cylindrically shaped hollow body being opposite to the internal threads.

17. A muzzle brake as claimed in claim 13 wherein the transverse wall of the internal chamber is substantially flat.

18. A muzzle brake for use with a gun having a longitudinal barrel axis, a muzzle and a bore, the muzzle brake comprising:

a cylindrically shaped hollow body having a rear end and a forward end, the body having internal threads adjacent the rear end for threadedly attaching the body to the muzzle adjacent the bore coaxially along the longitudinal barrel axis;

the cylindrically shaped hollow body defining an axially extending internal chamber with an inlet end having an inner diameter at least as large as an outer diameter of the muzzle and an outlet end at least as large as a diameter of the bore, the internal chamber defined by the cylindrically shaped hollow body having a substantially flat transverse wall adjacent the forward end of the cylindrically shaped hollow body;

a plurality of longitudinally extending, helically shaped slots through the body and in communication with the internal chamber, the slots being substantially equally distributed about the body, and each of the slots ending in an angularly disposed end wall adjacent the forward end of the body, the end wall in each of the slots being angled generally toward the rear end from an inner periphery of the body to an outer periphery of the body; and each of the plurality of helically shaped slots being further defined by substantially parallel first and second sidewalls defining an opening with an axis offset or non-intersecting with the longitudinal barrel axis, the internal threads and the offset being oriented so that propellant gases escaping through the helical slots strike the opposed sidewalls and tend to thread the muzzle brake tighter onto the barrel of the gun.

19. A muzzle brake as claimed in claim 18 wherein the plurality of helically shaped slots are evenly distributed to form pairs of opposed slots with the first sidewalls of each slot in a pair of opposed slots lying parallel with common diameters of the cylindrically shaped body.

20. A muzzle brake as claimed in claim 18 wherein the angularly disposed end wall of each of the plurality of helically shaped slots is angled generally toward the rear end of the body at an angle in a range of approximately 20 degrees to 60 degrees.

21. A muzzle brake as claimed in claim 18 further including threads in the outer periphery of the cylindrically shaped hollow body for attaching additional accessories, the threads in the outer periphery of the cylindrically shaped hollow body being opposite to the internal threads.

* * * * *